United States Patent [19]

Sanders

[11] 4,255,948

[45] Mar. 17, 1981

[54] STRESS REDUCING LATCH NEEDLE SHANK

[75] Inventor: Norman T. Sanders, Caersws, Wales

[73] Assignee: Needle Industries Limited, Studley, England

[21] Appl. No.: 899,900

[22] Filed: Apr. 26, 1978

[51] Int. Cl.[3] ..... D04B 35/04

[52] U.S. Cl. ..... 66/123

[58] Field of Search ..... 66/123, 121, 116, 122

[56] References Cited

U.S. PATENT DOCUMENTS

| | | | |
|---|---|---|---|
| 664,808 | 12/1900 | Dodge | 66/123 |
| 2,740,276 | 4/1956 | Minton | 66/123 X |
| 3,874,199 | 4/1975 | Mayer et al. | 66/123 |
| 3,875,767 | 4/1975 | Kopal et al. | 66/123 |
| 3,949,572 | 4/1976 | Kopal et al. | 66/123 |
| 3,990,269 | 11/1976 | Kopal et al. | 66/123 |
| 4,036,036 | 7/1977 | Ashmead et al. | 66/123 |
| 4,068,500 | 1/1978 | Kohorn | 66/123 |

FOREIGN PATENT DOCUMENTS

| | | | |
|---|---|---|---|
| 1635837 | 1/1970 | Fed. Rep. of Germany | 66/121 |
| 698987 | 10/1953 | United Kingdom | 66/123 |
| 804878 | 11/1957 | United Kingdom . | |
| 945027 | 12/1963 | United Kingdom . | |
| 1145150 | 3/1969 | United Kingdom . | |
| 1333568 | 10/1973 | United Kingdom . | |
| 1388466 | 3/1975 | United Kingdom . | |
| 1488605 | 10/1977 | United Kingdom . | |
| 1517294 | 7/1978 | United Kingdom | 66/123 |
| 135567 | 7/1960 | U.S.S.R. | 66/123 |

*Primary Examiner*—Werner H. Schroeder
*Assistant Examiner*—Andrew M. Falik
*Attorney, Agent, or Firm*—Owen, Wickersham & Erickson

[57] ABSTRACT

A latched needle having a hook portion and associated pivoted latch, the hook portion being connected to a shank portion leading to a butt portion for engagement by an operating cam. Proceeding along the shank portion from the latch pivot towards the butt portion, the shank portion has an increase in depth over part of its length and in respect of this part the transverse cross-section is modified to present asymmetry about a median plane parallel to the side faces of the shank portion as by cutting part of the thickness of the shank portion away over part of the depth to produce a stepped shape in transverse cross-section.

18 Claims, 7 Drawing Figures

11
13
14
10
10a
12
12a
12b
a
b
c
d
e
f
g
10b 4
5
15a
18
6
15
r
17
16
d

Cross-sectional area of shank portion
D

Length 19
15
17
16
20

21

15
19
17

16
21

19
15
17
20

16
21

112
111
113
110
115
114

110a
112a
112b
116
122
123
121
a1
b1
c1
d1
d2
e1
110b
f1

STRESS REDUCING LATCH NEEDLE SHANK

BACKGROUND OF THE INVENTION

Field of the Invention

This invention relates to latch needles (hereinafter referred to as being of the kind specified) comprising an elongate shank portion, a hook portion at one end of the shank portion, a latch element pivotally mounted on the shank portion for movement between closed and open positions with respect to the mouth of the hook portion, and a butt portion spaced along the shank portion from the hook portion.

The shank portion and the butt portion of a latch needle of the kind spcified is normally made of strip metal in the form of flattened metal wire and the side faces of the shank portion have depths which are greater than the thickness of the shank portion. In the following description, for convenience, it will be assumed that the side faces of the needle lie in vertical planes and that the edge faces of the needle are approximately horizontal, the hook portion is at the forward end and the butt portion is at or adjacent to the rearward end of the shank portion.

One of the principal applications of needles of the kind specified is in knitting machines. In such an application the needles may be mounted in grooves or, as they are termed, tricks, which extend longitudinally in the outer surface of a mounting cylinder for the needles, and the latter are reciprocated longitudinally in the tricks by cooperation between the needle butts and a cam.

For high productivity it is a requirement that the knitting machine shall be operated at the highest speed consistent with satisfactory knitting operation and service life of the component parts of the machine, but one of the limitations in this respect is failure of the needles which often takes place by fracture of the hook portion with or without part of the shank portion attached from the shank portion or the remainder of the shank portion.

It is known that this particular form of failure increases with increasing working speed of the knitting machine. Many studies have been made and experiments conducted in an endeavour to analyse or ascertain the cause or causes of this mode of failure with a view to developing solutions without any large measure of success having been achieved.

The present invention is based upon recognition that the principal cause of needle failure in the mode referred to is excitation of shock waves originating at the butt of the needle as a result of impact between the butt and the operating cam, and the reflection of such waves from the end of the needle at which the hook portion is situated. When a shock wave is reflected as aforesaid it travels reversely along the shank portion towards the butt and at some position along the needle spaced from the end of the hook portion, the needle is subjected simultaneously to shock stress arising from the leading end of the reversely travelling shock wave and the trailing end of the forwardly travelling shock wave, the stresses respectively being of opposite kind, e.g. compressive and tensile, so that they are additive.

SUMMARY OF THE INVENTION

The present invention is based upon the hypothesis that if the head (and possibly the tail) of the travelling shock wave can be modified from a form in which it lies in a plane at right angles to the longitudinal axis of the shank portion to some other configuration, then at the crossing position between the reflected and reversely travelling head and the forwardly travelling tail, the peak stress will be reduced with consequent reduction in the failure rate of the needles.

According to the invention we provide in a latch needle comprising an elongate shank portion, a hook portion at one end of the shank portion and having an open mouth, a latch element, pivot means for mounting the latch element on the shank portion for movement between closed and open positions with respect to the mouth of the hook portion, and a butt portion spaced along the shank portion from the hook portion, the improvement wherein proceeding along the shank portion from the pivot means to the butt portion, the shank includes at least a first part presenting a change in transverse cross-sectional shape relatively to that of an adjoining second part of the shank portion, succeeding said first part at the longitudinal boundary thereof nearer said butt portion.

The change of shape in transverse cross-section may be brought about by making said part of reduced thickness over at least part of its depth. Such reduction in thickness may, thus, start from one edge face of the shank portion but continue for part only of the depth of said first part.

Preferably the shape of said part in transverse cross-section is asymmetrical about a median plane parallel to the side faces of the needle.

Said first part of the shank portion may include a lower section having a thickness equal, or approximately equal, to that of longitudinally adjoining parts of the shank portion and an upper section of reduced thickness integrally connected along one of its longitudinal boundaries with said lower section and with said adjoining parts of the shank portion.

The upper section preferably has one of its outer faces coplanar with the corresponding side face of the lower section.

Further, in a direction along the shank portion from the butt portion towards the latch pivot, the depth of the lower section may gradually decrease and that of the upper section gradually increase for a predetermined distance along the shank portion towards the latch pivot. Thereafter the depth of the lower section may remain approximately constant or somewhat increase while the depth of the upper section may decrease.

BRIEF DESCRIPTION OF THE DRAWINGS

The invention will now be described, by way of example, with reference to the accompanying drawings wherein.

DESCRIPTION OF THE PREFERRED EMBODIMENT

Figure 1:
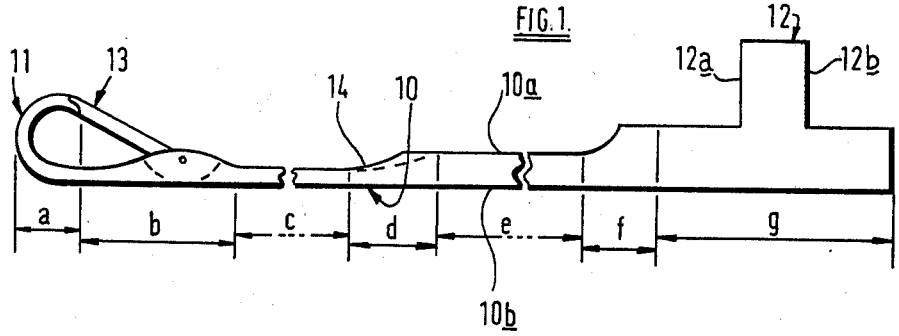
FIG. 1 is a view in side elevation of one embodiment of latch needle of the kind specified in accordance with the invention.

The latch needle shown in FIG. 1 comprises a shank portion 10 which is integrally connected at one end to a hook portion 11 and adjacent to its other end integrally connected to a butt portion 12.

Starting at the left-hand end of the needle the hook portion indicated at a which is integrally joined with the adjacent part b of the shank portion which is slotted medially to form two cheeks between which a latch element 13 is pivotally connected for movement between a closed position, as shown, and an open position in which the latch element lies back along the shank portion.

Continuing along the needle, the shank portion includes a part c for which the depth dimension is equal to, or a little less than, the maximum depth dimension afforded by the part b. Next, the shank portion includes a junction part d which serves to join part c to the part e, the latter having a depth which substantially exceeds that of the part c. The junction part d in a conventional needle provides a more or less gradual change of depth by way of a ramp edge 14, usually of somewhat concave form.

Likewise a further junction part f serves to connect the part e with a part g of still greater depth than the part e and from which the butt 12 projects laterally as shown. In a conventional needle all of the parts b, c, d, e and g have the same thickness. The thickness of the hook portion a is normally less than that of the part b but may, if desired, be deformed with respect to the blank of strip form in a manner to undergo some enlargement in thickness, i.e. the dimension at right angles to the planes of the side faces of the shank portion. In transverse cross-section the hook portion may be of circular or oval form.

Endwise reciprocating movement imparted to the needle by way of cam faces engaging contact faces **12*a* and 12*b* of the butt portion produce shock waves which travel lengthwise along the shank portion of the needle to the hook portion 11** and are then reflected. The shock wave may consist at its leading end of a local compressive stress followed at its tail end by tensile stress. Upon reflection from the terminal or end face of the hook portion one of these forms of stress, e.g. a compressive stress, "crosses" the opposite form of stress, e.g. a tensile stress, forming the tail of a shock wave and at the crossing point a high value of stress is produced. When this occurs at a relatively slender portion of the needle, i.e. one where the transverse cross-sectional area is at a minimum, for example near the junction of the parts a and b, fracture of the needle is apt to occur.

The peak value of stress for each crossing point depends not only upon the magnitude of the stresses in the head and tail portions of the shock wave but also upon the shape of the wave fronts. Thus, if on a simplified analysis the wave front of the head portion of the shock wave is regarded as being more or less planar and at right angles to the longitudinal axis of the needle and the trailing wave front at the tail is of like form, then at the crossing point, high additive stress will be produced across the entire transverse cross-section of the needle.

If, however, the form of the wave fronts can be modified, without significantly or seriously weakening the needle, then the value of the peak stress at the crossing point can be reduced.

With this object a part of the shank portion has its transverse cross-sectional area and shape modified. Satisfactory results have been achieved by modification in respect of the part identified at d as above mentioned.

For this purpose, and as seen particularly in FIGS. 2 and 4 to 6, the thickness of the part d is reduced for part of the depth of the part d leaving an upper section or web 15 connected integrally to a lower section and projecting upwardly therefrom, such web having a thickness which is less than the lower section 16. In transverse cross-section, as seen especially in FIGS. 4 to 6, the part d of the shank portion is thus of stepped shape in cross-section, as distinct from the rectangular shape presented by the adjoining parts c and e of the shank portion. The web 15 may be about one-third of the thickness of the lower section 16 but need not be of uniform thickness, e.g. it could be tapered towards its upper edge. Starting from the end nearest the butt portion, the depth of the metal removed from the web 15 increases up to the point **15*a* coinciding with the cross-sectional line 5—5. The depth of the lower section 16 decreases and that of the web 15 increases relatively without change in the overall depth of the shank portion. Thereafter, and continuing towards the hook portion, the depth of the web 15 is decreased while that of the lower section 16 decreases slightly at first and then begins to increase. The web may thus be formed by cutting away part of the shank using a circular milling cutter or the like tool having a peripheral radius r corresponding to the radius of curvature of the surface 17 forming a step face. The cross-sectional shape of the part d considered in any of the planes 4—4, 5—5 and 6—6 is asymmetrical about a vertical median plane 19 parallel to the side faces 21 of said part d of the shank portion (considered before any cutting away is effected to produce the section 15). It is also asymmetrical about a median plane 20** parallel to the edge faces and midway between them (again considered before any cutting away has taken place).

This asymmetry is considered to be an important factor in modifying the shape of the wave front of the shock wave.

It will be noted that the modification of the wave front of the shock wave brought about by the characteristic cross-sectional shape of the part d occurs in a portion of the needle where the depth, and hence the cross-sectional area as a whole, provides relatively low stressing compared with that which will exist at the junction of the hook part in the region a and the part b at the shank portion. Therefore, such modification can be carried out without detriment to the overall strength of the needle.

Figure 3:
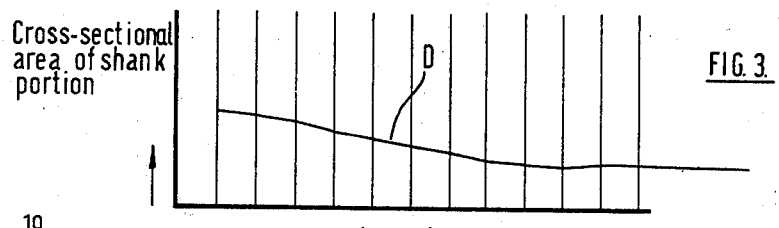
FIG. 3 is a graphical view plotting transverse cross-sectional area as ordinate against needle length as abscissa.
Figure 4:
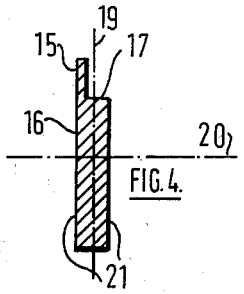
FIGS. 4, 5 and 6 show transverse cross-sections at lines 4—4, 5—5 and 6—6 of FIG. 2.
Figure 5:
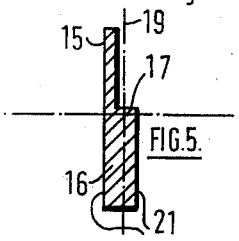
Figure 6:
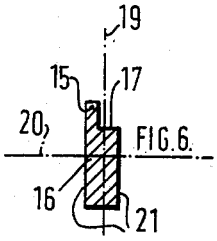

It will be noted from FIG. 3, in which the cross-sectional area is plotted as ordinate against length as abscissa, that the portion D of the curve corresponding to the part d of the shank portion shows a gradual decline in cross-sectional area from the value existing in respect of the part e to that existing in respect of the part c without abrupt changes.

It will be appreciated that in forming the part d of modified cross-section, two or more needle blanks may be clamped in side by side relation with their side faces in contact, and a milling cutter or other suitable tool having a width equal to twice the width of the surface 17 may be utilised simultaneously to cut away the shank portion of adjacent needle blanks which are then formed either left-handed or right-handed.

The needle may be formed from any suitable metal, for example plain, carbon or alloy steel of a composition in either case suitable for hardening and tempering. The thickness of the blank portions of the needle may typically range from 0.015 inches to 0.040 inches according to usage. The depth of the second part c of the shank portion may be approximately one half of the depth of the fourth part e which in turn may be approximately half the depth of the part g. The part c may range typically from 0.025 inches to 0.060 inches depending upon the usage to which the latch needle is to be put.

Figure 2:
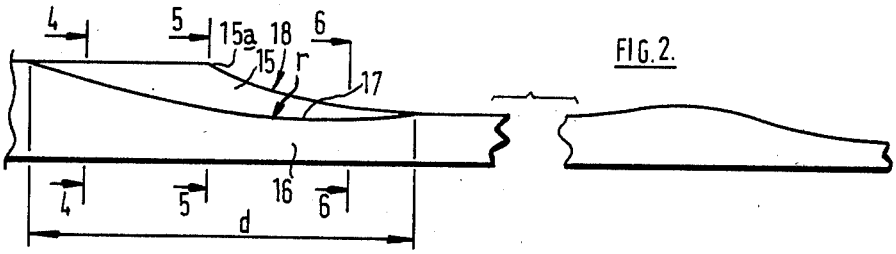
FIG. 2 is a view in side elevation looking towards the side opposite to that seen in FIG. 1 and on an enlarged scale showing a fragment of the shank portion of the needle of FIG. 1 to which the modification of transverse cross-sectional shape in accordance with the present invention is applied.
Figure 7:
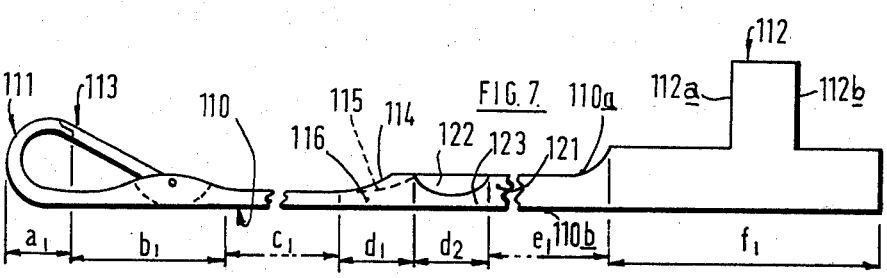
FIG. 7 shows a second embodiment of latched needle of the kind specified in accordance with the invention.

Referring to FIG. 7, parts corresponding to those already described with reference to the embodiment of FIGS. 1 and 2 are designated by corresponding references with the prefix 1 in the case of numerals and the suffix 1 in the case of letters, and the preceding description is to be deemed to apply.

In this embodiment the shank portion of the needle includes a further part d2 which is offset longitudinally of the shank portion from the part d1, and of which the thickness is reduced for part of the depth to provide a web or upper section 122 and a lower section 123 of unreduced thickness. The web 122 is offset laterally with respect to the vertical median plane parallel to the side faces 121 of the shank portion on the side of this median plane opposite to that from which the web 115 is offset. The thickness of the web 122 and the web 115 may, as in the case of the first embodiment, approximate to one third of the thickness of the unreduced lower sections 123 and 116 respectively, and in this case it would be possible for the webs 122 and 115 to overlap longitudinally to some extent at their adjacent ends. As illustrated, the web 122 follows on immediately after the web 115 in a rearward direction along the shank portion of the needle but there may, between the two parts d1 and d2 occupied respectively by the webs 115 and 122, be a short length of the shank portion of dimensions corresponding to those in respect of the part e1, i.e. which is not cut away to provide a web or portion of reduced thickness.

It will be evident that the transverse cross-sectional shape in any transverse plane throughout the part d2 is also asymmetrical about a horizontal median plane parallel to the edge faces of the shank portion of the needle.

Conveniently the cutting away of the shank portion of the needle to form the web 122 may be effected by a milling cutter which may have the same peripheral radius as that for cutting away the shank portion to form the web 115.

Tests which have been conducted have shown that the incorporation of a part d having the cross-sectional shape of the embodiment illustrated in FIGS. 1, 2 and 4 to 6 have very considerably extended needle life before failure occurs due to the shock wave effect already described. The incorporation of two parts d1, d2 of the form shown and described with reference to FIG. 7 has the effect of further extending the life before failure from the shock wave effect.

I claim:

1. A latch needle comprising an elongate shank portion of generally flat strip-like form defining a general longitudinal axis and having side faces and upper and lower edge faces, a hook portion at a forward end of the shank portion and having an open mouth, a latch element, pivot means for mounting the latch element on the shank portion for movement between closed and open positions with respect to the mouth of the hook portion, and a butt portion spaced rearwardly along the shank portion from the hook portion, wherein the shank portion of the needle includes a part between said butt portion and said pivot means over which said shank portion is reduced in thickness over part only of its depth to define an integral web or section which is asymmetrical with respect to a median plane parallel to said side faces and a median plane parallel to said edge faces, the depth of the web or section and of the remainder of said part being such as to define a progressive reduction of transverse cross-sectional area along said part from its rearward towards its forward end.

2. A latch needle according to claim 1 wherein said hook portion has its mouth facing upwardly and towards said shank portion, and said web or section starts from said upper edge face and is of substantially uniform thickness along its length and down to its lower boundary.

3. A latch needle according to claim 1 wherein:

a. the remainder of said part comprises a section having the full thickness of the shank portion, b. both of said sections are each of substantially uniform thickness, c. the depths of said sections of reduced and full thickness both vary longitudinally of said shank portion collectively in a manner to provide said progressive reduction in transverse cross-sectional area.

4. In a latch needle comprising a shank portion of generally flat strip-like form generally defining a longitudinal axis and having a pair of side faces and upper and lower edge faces; a hook portion extending from said shank portion at a forward end thereof and having an open mouth facing upwardly and toward said shank portion; pivot means on said shank portion; a latch element mounted on said pivot means for pivotal movement between an open position and a closed position relative to said mouth; and a butt portion spaced rearwardly along said shank portion from said hook portion, the improvement wherein:

a. said shank portion has a part of one of said edge faces which presents a ramp defining a gradual decrease of depth between said edge faces over at least a portion of the length of said part in a forward direction longitudinally of said shank, b. said part has a web or section of reduced thickness defined by a recess in one only of said side faces, c. said web or section extends longitudinally of said shank and has a depth less than the depth of said shank portion leaving an unrecessed full thickness section of said shank portion extending generally longitudinally and uninterruptedly along said shank portion between its ends and past said recess.

5. The improvement according to claim 4 wherein the ramp is presented by the upper one of said edge faces into which it opens, and has a lower boundary at a position spaced upwardly from said lower edge face.

6. The improvement according to claim 5 wherein said part comprises an upper section and a lower section integrally connected with each other and collectively presenting at said one side face of said shank portion a transverse cross-sectional shape of stepped form formed by one side face of said upper section, a step face at the upper end of said lower section and one side face of the lower section, the other side faces of said upper and lower sections being coplanar.

7. The improvement according to claim 4 wherein the sections of reduced and full thickness each have a substantially uniform thickness and that of the reduced thickness section is about one third of that of the full thickness section.

8. The improvement according to claim 6 wherein said recess and resultant web or section of reduced thickness begin at a position rearwardly of said ramp, and continue forwardly therealong, and said step face forming the lower boundary of said web or section inclines downwardly in a forward direction longitudinally of said shank portion but at a less steep inclination than is presented by said ramp.

9. The improvement according to claim 8 wherein said step face is of concave arcuate form longitudinally of said first part and extends from the level of the upper edge face at the rearward end of the ramp to the level of the upper edge face at the forward end of the ramp.

10. The improvement according to claim 9 wherein said upper section has an upper edge face which in the forward longitudinal direction extends substantially parallel to said lower edge face of said shank portion up to the mid region of the length of said part, and then extends forwardly and downwardly by way of said ramp.

11. In a latch needle comprising a shank portion of generally flat strip-like form generally defining a longitudinal axis and having a pair of side faces and upper and lower edge faces; a hook portion extending from said shank portion at a forward end thereof and having an open mouth facing upwardly and toward said shank portion; pivot means on said shank portion; a latch element mounted on said pivot means for pivotal movement between an open position and a closed position relative to said mouth; and a butt portion spaced rearwardly along said shank portion from said hook portion, the improvement wherein:

a. said shank portion has at each of two positions along its length a web or section of reduced thickness defined by a recess in a part of said shank portion situated between said butt portion and said hook portion and formed in one only of said side faces, b. each of said recesses begins at one of said edge faces into which it opens and continues towards the other edge face terminating in a boundary spaced depthwise from said other edge face and extending longitudinally of said shank portion, c. said boundary has a configuration and a spacing from said other edge face of said shank portion in a manner to define a residual full thickness section of said shank portion extending generally longitudinally and uninterruptedly along said shank portion past each of said recesses.

12. The improvement according to claim 11 wherein each of said recesses begins from said upper edge face, and said reduced and full thickness sections are each parallel-sided with the upper section having a thickness less than the lower one, and each said section having one side face coplanar with the other said section.

13. The improvement according to claim 12 wherein said boundary is of concave arcuate form in a direction longitudinally of said shank portion.

14. In a latch needle comprising a shank portion of generally flat strip-like form generally defining a longitudinal axis and having a pair of side faces and upper and lower edge faces; a hook portion extending from said shank portion at a forward end thereof and having an open mouth facing upwardly and toward said shank portion; pivot means on said shank portion; a latch element mounted on said pivot means for pivotal movement between an open position and a closed position relative to said mouth; and a butt portion spaced rearwardly along said shank portion from said hook portion; the improvement wherein:

a. said shank portion has recesses situated at respective longitudinal positions between said hook portion and said butt portion, each of said recesses defining a web or section of reduced thickness, b. each of said recesses is formed in a respective one only of said side faces and begins at one of said edge faces into which it opens and ends at a boundary spaced depthwise of said shank portion from the other of said edge faces, c. longitudinally successive ones of said recesses are formed in oppositely presented ones of said side faces respectively, d. said shank portion includes an unrecessed full thickness section which extends longitudinally of and uninterruptedly along said shank portion past each of said recesses.

15. The improvement according to claim 14 wherein said recesses each start from said upper one of said edge faces, and said reduced thickness section and said full thickness sections are integrally connected with each other and collectively present a transverse cross-sectional shape of stepped form formed by one side face of said reduced thickness section, a step face at the upper end of said full thickness section and one side face of said full thickness section, the other side faces of said sections being coplanar.

16. The improvement according to claim 15 wherein said sections are of substantially uniform thickness and said reduced thickness section has a thickness of about one third that of the full thickness section.

17. The improvement according to claim 15 wherein each of said step faces is of concave arcuate form.

18. The improvement according to claim 15 wherein the lower edge face of said shank portion is parallel to said axis and the upper edge face includes a ramp which slopes downwardly in a forward longitudinal direction and overlaps longitudinally with the forwardly situated one of said recesses.

* * * * *